United States Patent [19]

Glock et al.

[11] Patent Number: 4,484,376

[45] Date of Patent: Nov. 27, 1984

[54] BLOCKING DEVICE FOR ROVINGS ON SPINNING MACHINE DRAW FRAMES

[75] Inventors: Alfred Glock; Rudolf Schön, both of Stuttgart; Bernhard Schönung, Filderstadt; Kurt Seebo, Esslingen, all of Fed. Rep. of Germany

[73] Assignee: SKF Kugellagerfabriken GmbH, Schweinfurt, Fed. Rep. of Germany

[21] Appl. No.: 335,210

[22] Filed: Dec. 28, 1981

[30] Foreign Application Priority Data

Jan. 2, 1981 [DE] Fed. Rep. of Germany ..... 3100049
Nov. 19, 1981 [DE] Fed. Rep. of Germany ..... 3145798

[51] Int. Cl.[3] ..... D01G 31/00; D01H 5/86

[52] U.S. Cl. ..... 19/0.25; 19/236; 19/244

[58] Field of Search ..... 19/0.25, 236, 239, 240, 19/244; 57/81, 87

[56] References Cited

U.S. PATENT DOCUMENTS 2,636,223 4/1953 De Santis et al. ..... 19/0.25 X
3,271,823 9/1966 Whitehurst ..... 19/0.25
4,432,195 2/1984 Stahlecker ..... 57/87

FOREIGN PATENT DOCUMENTS 321196 5/1920 Fed. Rep. of Germany .
2048579 5/1971 Fed. Rep. of Germany .

*Primary Examiner*—Louis Rimrodt
*Attorney, Agent, or Firm*—Murray Schaffer

[57] ABSTRACT

A drawing frame for a spinning machine is provided with a blocking mechanism movable into a position between the upper and the lower feed rollers in the event of yarn breakage, to lift the roving from contact with the driven roller. A roving holder facilitating the holding of the tuft end of the roving between the drawing and outlet rollers is provided. This latter apparatus is coupled to the means for actuating the blocking mechanism for synchronous operation and is provided downstream of the inlet roller. It comprises a table extending beneath the roving and a rotatable shaped arm above the roving which arm is movable by the switching mechanism to simultaneously hold the front end of the roving.

18 Claims, 13 Drawing Figures

BLOCKING DEVICE FOR ROVINGS ON SPINNING MACHINE DRAW FRAMES

BACKGROUND OF THE INVENTION

The present invention relates to apparatus for blocking the movement and/or feeding of roving to the draw frame of a spinning device.

It is known to provide a slubbing or roving blocking device having a member which moves into a blocking position between the lower entry roll and the upper entry roll of a draw frame in the event of yarn breakage, and which lifts the upper feed roll from the lower feed roll, while holding the roving fast between itself and the upper roller (DE-PS No. 3 21 196 and DE-OS No. 20 48 579.

The part of the roving not held fast is moved further along the spinning path by the drawing pair of drawing rollers which continue to remain in an operating condition, so that a fiber tuft is formed in the area between the entry roller pair and the blocking point of the drawing roller pair. This fiber tuft, however, constitutes the initial section of the roving necessary to repiece the yarn, after removal of the blockage and restart of spinning. Fiber tufts may differ greatly in their length and cross section, with the result that variable prerequisites are created for the subsequent repiecing. Substantial differences also result from the roving material used, depending on whether it is a cotton or worsted yarn.

For example, cotton has a relatively short staple length, and therefore, the distances between the entry rollers and the succeeding drawing roller pairs (referred to as the forefield) is selected so that it is between one and a half and twice the mean staple length. The drawing roller pair is, as a rule, a twin belt unit running over a pair of solid rollers which act to twist the fibers into the thread. A cotton fiber tuft will finally stand free in the area of the forefield, and will approach the drawing rollers at variable distances, depending on the share of floating fibers still remaining in the blocked part of the roving, i.e. those fibers which are located neither in the blocking device nor in the nip formed by the drawing pair of belts. Part of the floating fibers are carried along after blockage is effected by the fibers already present in the twisting belts as well as those continuing to enter the latter.

A worsted yarn roving has, however, a share of fibers which are distinctly longer than the length of the normal forefield. It is for this reason that the roller pairs over which the twisting belts pass contain at least one roll having an annular channel by means of which the fibers running into the twin-belt unit may be pulled tight but not torn. When the roving is blocked between the upper entry roll and the blocking device, the fiber tuft created in the forefield extends up to the drawing nip, ergo into the twin belt assembly. The thus relatively long fiber tuft has then a cross section which decreased over this long area. Thus, when restating the machine, a relatively long period of time is required until the fibers emerging from the final pair of exit rolls of the draw frame have again attained a cross section resulting in a full, unobjectional thread.

Furthermore, there exists the danger, with both roving materials that the completely or partially free-standing tuft in the area in front of the drawing rollers will not enter the subsequent nip point on restart, since the movement of the free-standing roving is performed by sliding the roving from its upstream end.

Although it is known (see the previously cited DE-PS No. 3 21 196) to arrange a guide plate below the roving in the forefield area, which has the purpose of preventing the fiber tuft from falling down and to guide it to the following drawing roller pair, positive guidance is not always assured because during the initial movement of the roving its sliding exposed fibers may encounter resistance on the guide plate. When this occurs the fibers may ball themselves up in a compressed manner, lift the roving off the guide plate and deflect it from the desired path. A further possibility for interfering with the proper guidance of forward end of the roving occurs from the travelling blowers used for cleaning the machine. A strong purifying air stream is directed from a blower which travels alongside the machine. This air stream is capable of blowing the exposed fiber tuft and its exposed parts aside, as well as snapping them off the roving, and blowing them from the guide plate. There exists therefore the danger in every case that the roving will not enter the subsequent clamping point of the drawing rollers, causing it possibly to contact rotating parts of the draw mechanism, be caught and pulled up by the latter to form a coil. The use of the guide plate supporting the beginning of the roving is limiting and prevents a shortening of the length of the forefield so that adjustment to a material of different staple length cannot be made unless serial guide plates of different length are provided.

The present invention has the task of eliminating these shortcomings and of creating simple arrangements which assure that a roving is held fast in case of yarn breakage between the upper entry roll and a blocking member, while insuring its free running into the nip point of the draw rollers following the pair of entry rolls. Even if the starting section of the roving has been exposed previously to a purifying airstream sweeping over the draw frame.

SUMMARY OF THE INVENTION

The foregoing task has been solved by the present invention which provides a draw frame for a spinning machine converting a roving into a thread or strand having upper and lower paired inlet and outlet rollers and an upper and lower paired drawing roller with twisting belt covers and means for sensing a break in the roving or thread is provided which actuates a blocking device arresting the motion of the roving. A holding device is provided for securing the forward end of the roving in alignment with the drawing rollers responsive to switch means operable by the sensing means for causing the blocking and holding devices to brake the roving. The holding device is adjustably mounted between the paired inlet rollers and the drawing rollers along the path of movement of said roving.

The holding device includes a supporting plate adapted to pass beneath the roving and an upper rotatable arbor member, having a shaped cross-section which in one rotated position forms a space for the moving roving and in another position secures the roving to the lower supporting plate.

The roving holderholds the tuft in readiness for restart and protects the exposed fiber tuft upstream of the drawing rollers (forefield) and its free-standing fiber parts from the effects originating from possible travelling blowers. It also holds the tuft until the roving resumes its movement.

The roving holder is adjustable and can be provided with a position which is optimally adapted to the length of respective fiber material and the formation of its fiber tuft, and can be arranged, e.g. with cotton upstream of the drawing rollers in such a manner that it no longer catches those fibers which have already entered the clamping point at the drawing rollers, while still holding on to fibers floating in the roving section located between the upper entry roll and the blocking member. Thereafter, a fiber tuft extending almost to the clamping point of the drawing rollers is created, running into the clamping point without any interference.

In case a roving of worsted yarn is used, the roving holder can be assigned a position, in which it still holds a large portion of the floating fibers in the section of roving situated between the upper entry roll and the blocking member, as a result of which the formation of the fiber tuft and the reduction of the roving profile begin essentially only downstream the roving holder and a full profile fiber bundle suitable for piecing to a flawless thread becomes available at the draw frame exit shortly after the roving resumes its movement. As a structural component holding the roving, the roving holder can be designed substantially shorter in the running direction of the roving than a guide plate merely supporting the roving only on its underside. For this reason, the roving holder can be adjusted both in a long and short field in front of the draw frame within a large area according to requirements.

Advantageous further developments of the invention arise from the formation of a structural group containing the essential components of the device for blocking and holding the roving, which can be mounted on a portable bearing rail which is easily attachable to new machines, as well as machines which have already been put in operation. As a result, both the initial assembly of the components of the device for blocking and holding the roving on the machine and also the preliminary work required for cleaning, maintenance, and resetting purposes on draw frames equipped with the device for blocking and holding the roving are simplified and the subsequent resumption of operation of the draw frames is facilitated.

Through the tiltable seating of the bearing rail in a support piece, which is attached to the machine, the bearing rail with the components of the device for blocking and holding the roving can be moved out of the manipulating range by tilting in the same way as the upper rollers of the draw frame are lifted by their tilting support arm and can be returned to the operating position by a reversed tilting motion. By designing the blocking member as a wedge fastened to and movably sliding alongside the bearing rail, the latter forms with the components firmly arranged on it a complete structural group meeting the blocking and holding functions for the roving and this structural one-unit design facilitates also the initial assembly on the machine.

The further developments assure in a simple way exact and safe positions of the bearing rail in its operating and nonoperating position. The blocking member is a wedge which is mounted on a slide movably into selected positions along the support arm in a simple manner, making it possible to adapt the device easily to draw frames of variable types of construction and also to the variable adjusting possibilities of a certain draw mechanism.

A further measure assures that in the readiness position of the blocking member, the blocking wedge remains with certainty outside of the range of movement of the roving and that only during its movement into the blocking position is braced against the lower roll, while lifting the upper roll and the roving from the lower roll. Therefore, no stresses acting on the bearing rail exist.

This invention is illustrated in greater detail in the following by way of examples.

DESCRIPTION OF THE INVENTION

Figure 1:
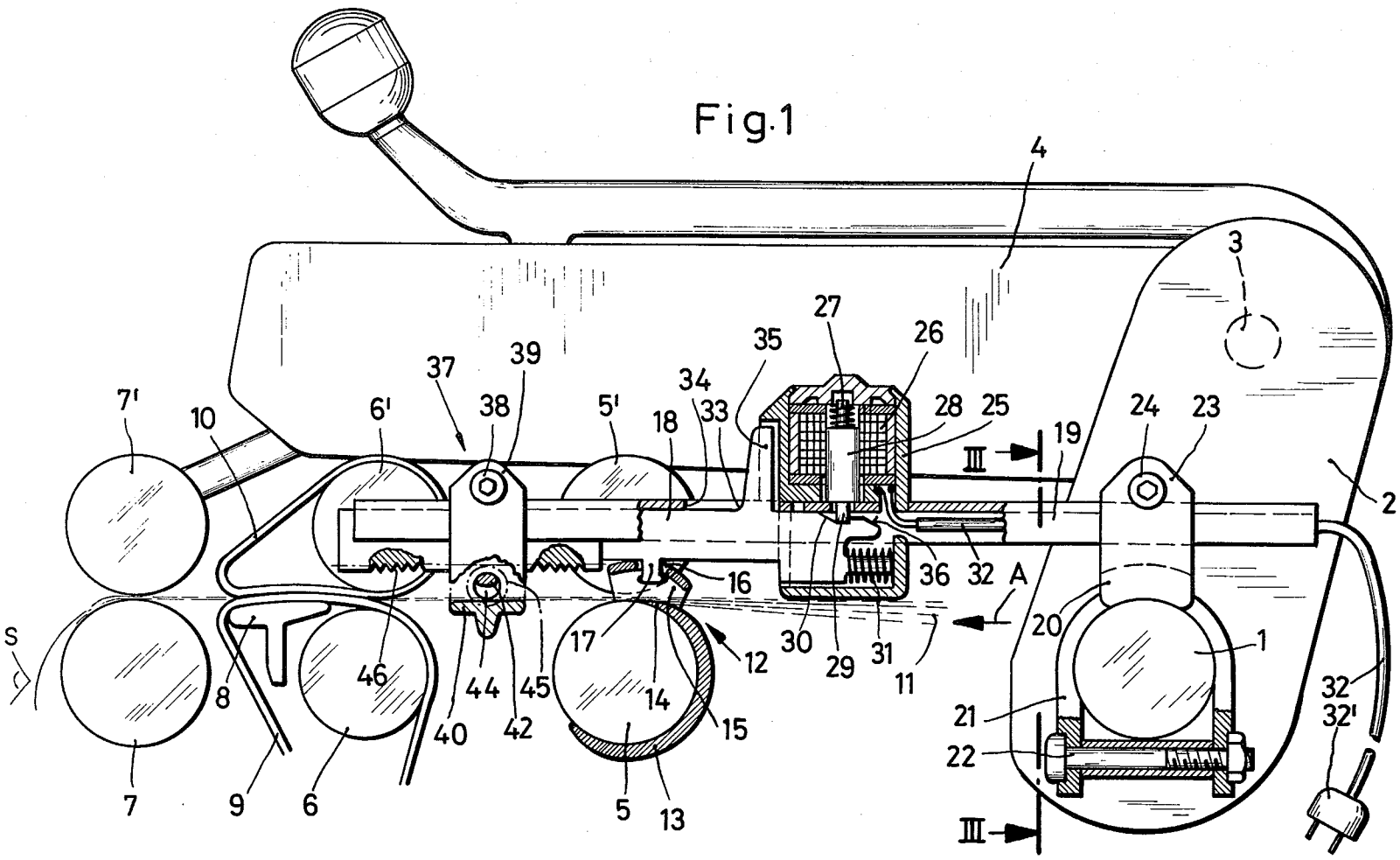
FIG. 1 is a side view of a draw frame (drawing mechanism with a roving blocking device represented partially broken open and a roving holder arranged in the area downstream thereof (forefield) in their positions during the running of the draw frame.
Figure 2:
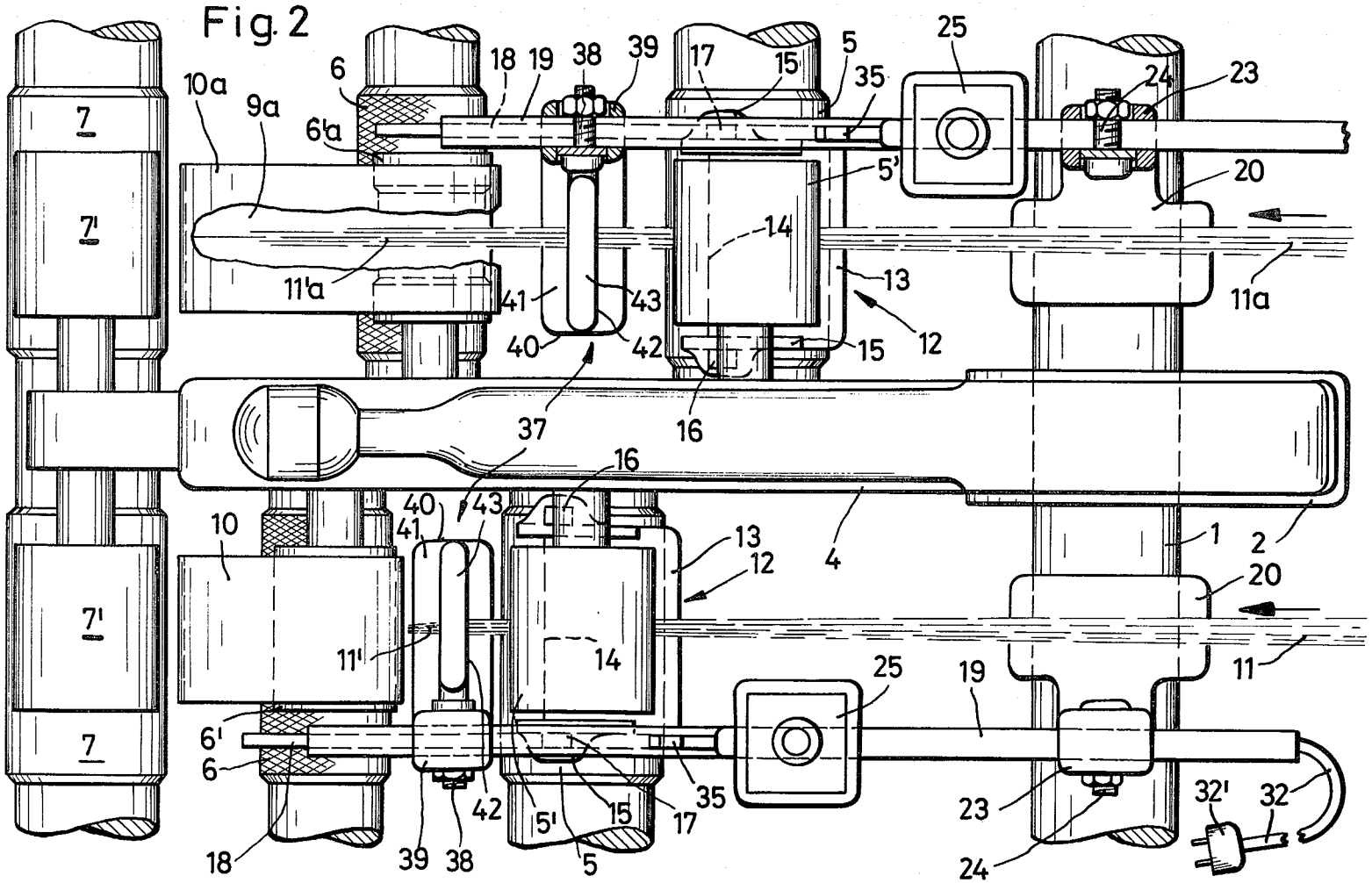
FIG. 2 is a plan view of the draw frame, wherein the support and load carrying arm is shown between two sets of rollers, each in a different adjusted position; the rollers shown below the support arm corresponds to FIG. 1 the draw frame in a position adjusted for the processing of a cotton roving, and the rollers illustrated above the support and load carrying arm is in a position adjusted for processing of a worsted yarn roving.
Figure 9:
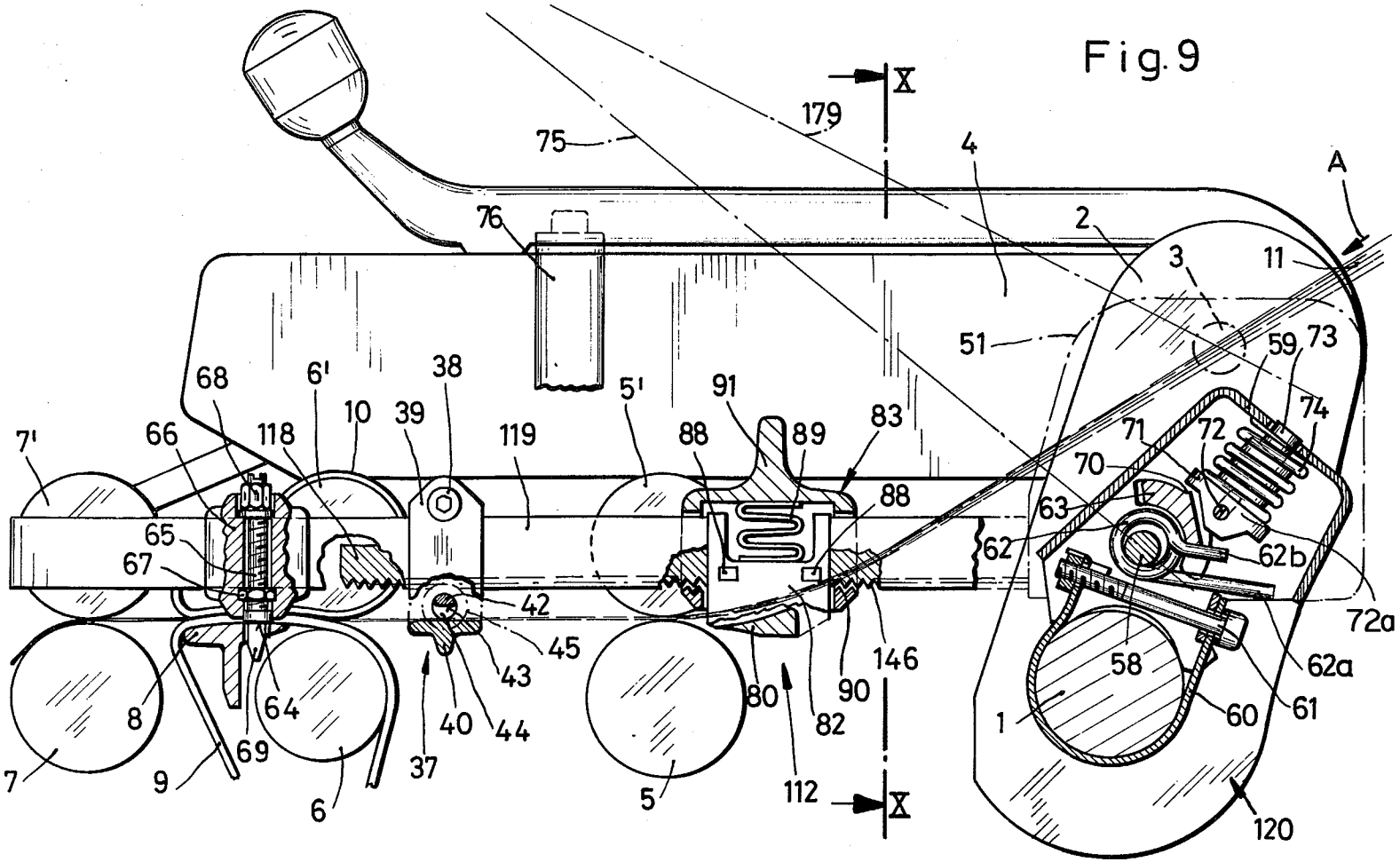
FIG. 9 is a view similar to FIG. 1 of a draw frame with a bearing rail having a modified roving blocking and holding device, shown partially in section.
Figure 10:
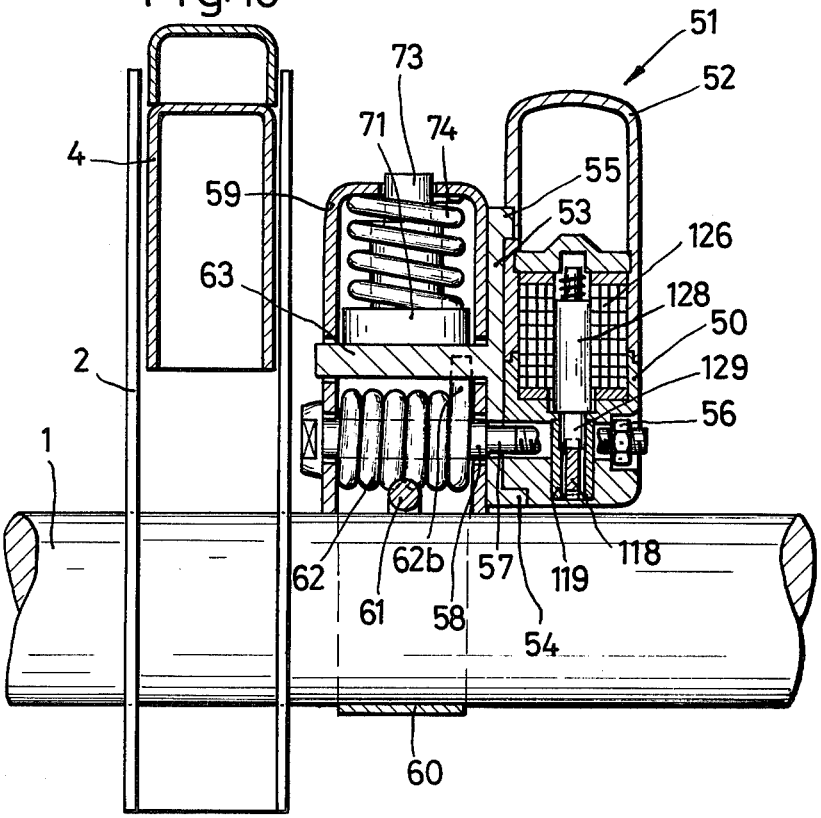
FIG. 10 is a view taken along the line of intersection X—X of FIG. 9.

A single draw frame having two parallel spring paths is illustrated especially in FIGS. 1, 2 and 9. The draw frame, as well as others, are mounted on a load carrying support 2, which is fastened to a horizontal rod 1 secured in position in a spinning machine. Swivable about a bearing 3 journaled in the support 2 is a support and load arm 4, shown in its operating position. Mounted in the frame below each edge of the arm 4 are sets of driven lower rolls 5, 6, and 7 which can be adjusted with respect to their axial distance from one another, with respect to the support rod 1 and with a desired variable width. The lower rollers are mounted in bearings and driven in a manner known and therefore not shown in greater detail. Twin upper rolls 5', 6', and 7', depend from the arm 4 to normally rest on and be driven by the lower rolls 5, 6, and 7. The paired rolls 5, 5' form a roving entry pair, paired rollers 6, 6' form a drwing pair, and paired rollers 7, 7' form an exit pair for the converted thread or yarn. A lower twisting belt 9 runs over the lower roller 6 and a bridge 8 prearranged in front of the latter. A corresponding upper twisting belt 10 runs over the upper rollers 6' and a cage (not illustrated) in opposition to the lower belt.

A roving 11 traverses the draw frame in the direction of the arrow A. A thread sensor S is arranged downstream of the final exit roller pair 7, 7' before the thread is wound on a bobbin, cop or the like, to sense the continuity of the thread. Upon sensing a break in the thread, the sensor causes the release of a roving blocking device identified generally in FIGS. 1 and 2 by the numeral 12, the latter shown in FIG. 1 in the position not blocking the roving 11, while in FIG. 2 it is moved into the blocking position.

The essential component of the roving blocking device 12, which is known per se, is a cylindrical shell 13 placed over the lower roll 5, to surround it by slightly more than one half its circumference. The shell 13 is secured against co-rotation with the roller and has a tapering edge 14 which is adapted to move between the rollers 5, 5'. The axial length of the blocking shell 13 is longer than that of the upper roll 5'. When the shell 13 is turned from its readiness position, shown in FIG. 1, into the blocking position by an impulse produced in response to the thread sensor in the event of yarn breakage, its edge 14 penetrates between the roving 11 and the lower roller 5 and thereafter into clamping position against the upper roller 5'. The shell 13 is then locked in position, clamping the roving 11, which has been lifted off the lower roll 5, against the upper roll 5'. The upper roller 5' is also lifted off the lower roll 5 and is braked against further movement. This stops the further delivery of fibers to the drawing rollers 6, 6' and the exit rollers 7, 7' and prevents loss of fibers or roving and also prevents the formation of fiber coils in this area.

Up to this point, the roving blocking device is known per se.

In the device illustrated in FIGS. 1 to 8, the control of the shell 13 effecting the blocking and release of the roving 11 is carried out in the following manner.

Figure 3:
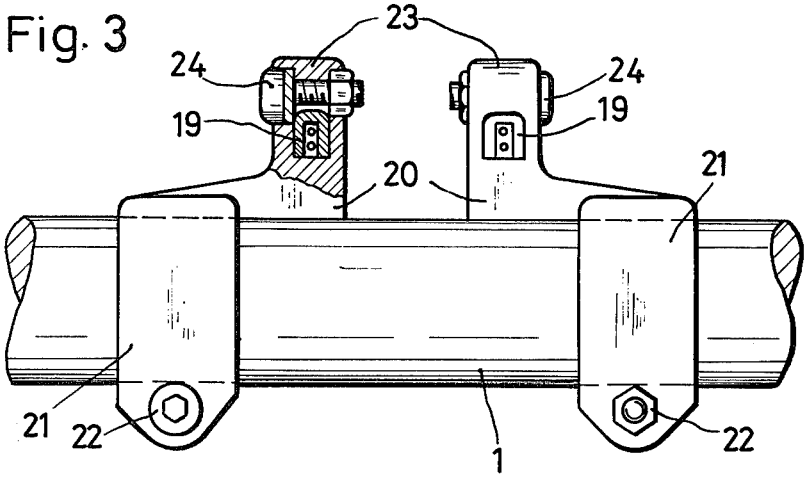
FIG. 3 is a sectional view of the supporting rod taken along line III—III of FIG. 1.

A radially projecting coupling joint preferably made of plastic and having a recess 16 is formed at both axial ends of the blocking shell 13 which is also preferably made of plastic material. One of these recesses is engaged by a coupling projection 17 formed on a rectangular slide 18. The slide 18 which can be moved lengthwise, rests in a bearing rail 19 of U-shaped cross section which is adjustable lengthwise and fixed in position in a carrying member 20. The carrying member 20 is held by a mounting bracket 21, which is open on one side and is itself mounted on the support rod 1. The bracket 21 is tightened about the rod 1 by a clamping screw 22 and thus is capable of being positioned on the support rod 1 at any desired point. The carrying member 20 is furthermore provided with a fastening joint 23 for the bearing rail 19 comprising a first recess conforming to the cross section of the rail 19 and a second recess at a right angle to it serving to accommodate a fastening screw 24 having a nut and a serrated washer, see especially the open respresentation in FIG. 2, top right, as well as FIG. 3. In contrast to the representation of FIG. 2, FIG. 3 shows the manner in which the carrying members 20 are placed on the supporting rod 1 between two adjacent support and load carrying arms. The washer, which abuts with its serrated marginal area on the side surface of the bearing rail 19 when the screw 24 is tightened, assures an especially safe fixed position of the rail in the joint 23 of the carrying member 20. The carrying member 20 is designed and fixed on the support rod 1 in such a way that the bearing rail 19 held therein extends parallel to the running direction of the roving.

As recognizable, especially from FIG. 1, a housing 25 is attached to the bearing rail 19 and contains an electromagnet 26, whose anchor 28, which is under the force of a stop spring 27, is provided at its free end with an extension forming a bolt 29. This bolt 29 is biased by the stop spring 27 to normally engage in a notch 30 cut into the longitudinal edge of the slide 18, the end of which projects into the housing 25. A horizontal pressure spring 31, attached about a finger formed on the end of the slide 18 below the notch 30, braced against the inner wall of the housing 25, normally urges the slide 18, with reference to the illustration in FIG. 1, to the left against the anchor 28. Should the anchor 28 be moved by brief excitation of the electromagnet 26 so that its bolt 29 is removed from the notch 30, the spring 31 will force the slide 18 to move to the left. The electromagnet 26 is connected by means of a cable 32 laid into the bearing rail 19 and led out at its end by a plug 32' to the output of a pulse formation device controlled by the thread sensor. It should be mentioned that the pulse for the excitation of the electromagnet 26 can also be emitted by a control means not directly associated with the thread, for instance, by a control member sensing the standstill of the spinning ring traveler through which the thread passes before winding.

In the event of a yarn rupture by which the electromagnet 26 is excited, the pressure spring 31 moves the then unlocked slide 18 to the left. The slide 18 carries its coupling projection 17, in the same direction, turning the blocking shell 13, held up to this time in its readiness position, in a counterclockwise direction by means of its connection with the coupling 15. The slide 18 moves to the left until one edge 33 on the upper surface of the slide 18 contacts a counteredge 34 fashioned on the bearing rail 19. In this position of the slide 18, the blocking shell 13 has completed its rotation and is in the already described position clamping the roving 11 fast between itself and the upper roll 5', lifting the roving off the lower roll 5 and braking the roving against further movement (see the position of the parts in FIG. 2).

The stop edge 33 is a part of a hand lever 35 formed on the slide 18 projecting through an open slot in the bearing rail 19. By this means the slide 18 can be pushed back again into the readiness position as shown in FIG. 1 thereby releasing the blocking shell 13 and permitting restraint of the drawing operation. To facilitate the reloading of the slide 18, its rearmost end is provided with an inclined surface 26, over which the spring biased bolt 29 can ride.

The roving tuft end piece holder is denoted in the FIGS. 1 and 2 generally by the numeral 37 and is arranged relative to the roving 11 in the area between the paired entry rollers 5, 5' and the drawing rollers 6, 6'. The clamping point of the paired drawing rollers is formed in the illustrated example, by the point at which the roving is nipped between the belts 9, 10 running over the rollers 6, 6'. The roving holder 37 is adjustably arranged in front of the drawing rollers alongside the roving by placing the holder 37 on the bearing rail 19 so as to be slidable in a lengthwise direction and providing a clamping screw 38, to secure the holder 37 at any desired point on the rail.

As may be seen especially from FIG. 14, the roving holder 37 comprises an L-shaped holding body 39, containing a recess in its vertical leg adapted to the cross section of the bearing rail 19 and the part of the slide 18 still projecting from the latter, by means of which it is pushed onto these parts 18 and 19. The clamping screw 38 is inserted into the holder body 39 and its associated nut and serrated washer press the sides of the body firmly against the bearing rail 19 establishing thereby a solid connection between the rail 19 and the body 39, while permitting the slide 18 freedom of movement.

Figure 4:
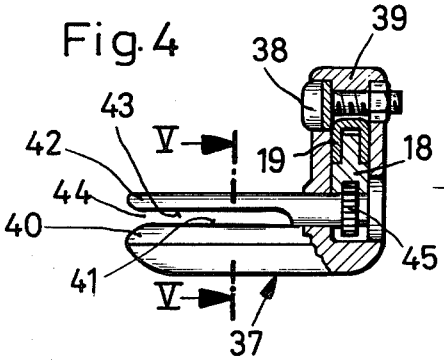
FIG. 4 is a sectional view of the roving holder, partially broken open.
Figure 5:
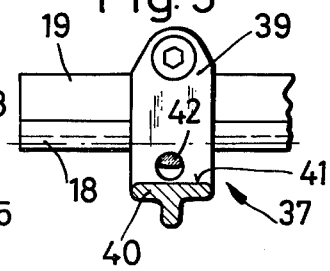
FIG. 5 is a sectional view of the roving holder taken along line of intersection V—V of FIG. 4.

The horizontal leg of the body 39 forms a supporting table 40 which reaches under the roving 11 and constitutes a stationary part when the holder body 39 is fixed to the rail. Parallel to the extension of the table 40 and spaced from its upper surface 41 so as to overlie the roving 11 is a cantilevered rod-like arbor 42. The rod 42 is pivotally mounted at its inner end so as to be rotatable about its central axis at close distance above the table surface 41. The rotatable rod 42 is generally round having a surface sliding in contact with the surface 41, but has a flattened cross sectional sector 43 over the greatest part of its freely projecting length, so that when rotated, as illustrated in FIGS. 4 and 5, defines with the table 41 a slot 44 through which the roving 11 can move unhindered. A gear 45 mounted at the inner end of the pivot rod 42, engages a toothed rack 46 formed on the lower edge of the slide 18.

The roving holder 37 is attached to the rail 19 in such a way that when the slide 18 is in the normally locked position, i.e. rearmost as in FIG. 1, the blocking device 12 is in readiness, i.e. open position, and the gear 45 in engagement with the rack 46, as shown in FIG. 1, is adjusted to a position in which the slot 44 exists between the flattened surface 43 and the table surface 41. This allows free movement of the roving 11 and operation of the spinning frame.

In case of yarn breakage, the slide 18 unlocks and moves the shell 13, in the manner already described, into the position blocking the roving 11, causing the rack 46 to impart at the same time a half turn to the gear 45 and thus to the arbor or rod 42. The rod 42 stands then with its unflattened or rounded surface close to the surface 41 of the table 40, and the forward end of the roving 11 is now held fast in narrowed space.

In the lower half of FIG. 2, the parts are illustrated holding a cotton roving 11. It can be seen that the fiber tuft 11' produced in the area prior to the drawing rollers (forefield) during the blocking of the roving by the device 12 is held in the holder 37 and thus cannot be pushed aside by any air current from a cleaning blower or the like. It is shown furthermore, that the fiber tuft 11' downstream of the holder 37 can be placed very close to the subsequent nip point formed by the double-belt unit 9, 10 because the share of floating fibers remaining in the fiber tuft 11' is increased as well as being supported by the holder 37. It is, therefore, assured that the moving roving 11 with its tuft 11' enters fully into the nip of the double belt assembly 9, 10 when the blockage is lifted and restart effected by actuation of the hand lever 35 which simultaneously releases the tuft 11' from the roving and the blocking device 12. As a result, the tuft end may be easily pieced with the prior spun thread.

The upper half of FIG. 2 shows the drawing rollers in a position adjusted for processing a worsted yarn roving 11*a*. In adjustment to the staple length of this material, the lower rolls 5 and 6 are set apart by larger distance between their centers, and the lower exit roll 7 respectively, and the same applied to the upper rolls 5', 6', and 7'. The distances with respect to the support rod 1 are also changed.

The blocking device 12 and the holder 37 can be adjusted in a simple manner to these changed conditions. First, however, loosening the clamping screw 22 makes it possible to swing the carrying piece 20 with the bearing rail 19 fastened in it and the parts attached to the latter about the support rod 1 upward into a position, in which the adjustments of the rollers are not hindered. The engagement of the projection 17 in the recess 16 is also released. If necessary, the carrier 20 and all its mounted parts may also be completely taken off the machine by removal of the clamping screw 22. Upon reattachment of the carrying member 20, loosening of the fastening screw 24 permits the bearing rail 19 with its slide 18 and the latter's coupling projection 17 to be pushed into the position adjusted to the changed position of the lower roller 5 and into engagement with its shell 13. After loosening the clamping screw 38, the holder 37 can also be moved along the bearing rail 19 and positioned again by tightening of the clamping screw 38 at a point adapted to the changed roving material and its fiber tuft formation, so that the devices 12 and 37 are finally arranged with respect to each other spaced at the changed sites, but functionally in the manner illustrated in FIG. 1.

When the worsted yarn roving 11*a* is blocked, a fiber tuft 11'*a* is formed, as shown in FIG. 2, top, the latter extending to the double belt assembly consisting of the now longer upper and lower belts 10*a* and 9*a* respectively, and containing a upper roll 6'*a* having an annular groove in its face. The arrangement of the holder 37 in the area in front of the drawing rollers (6,6') accomplishes the result that during blockage the part of the roving projecting from the blocking device 12 that is the share of floating fibers is retained, which, if the holder 37 were not present, would still have been pulled out of the roving by the still running double-belt drawing roller assembly. This leads to a fiber tuft, the cross section of which would decrease after the blocking site 14, 5'. With the holder 37 present, however, the reduction of the cross-section of the roving and the formation of the fiber tuft begin only downstream of the holder 37, so that after the lifting of the blocking and detention of the roving the fiber bundle which emerges again from the exit rollers 7, 7' has its full profile, resulting in a flawless thread which can be pieced to the bobbin thread. In addition, the holder 37 protects the fiber tuft in the longer front area (forefield) against the proportionately still greater disruption potential caused by cleaning blowers.

In the holder 37 described to this point, the roving is held relatively firm between the non-flattened part of the outer surface of the rod 42 and the area 41 of the table 40, because these parts are arranged rigidly, with respect to one another at a relatively close distance.

The degree of clamping of the roving in the holder 37 can be adapted in a simple manner to the roving material, to rovings of varying thickness, and to the draft and spinning conditions. The position can be selected in such a way that no floating fibers or a more or less large portion of them is detained in the fiber tuft.

Figure 6:
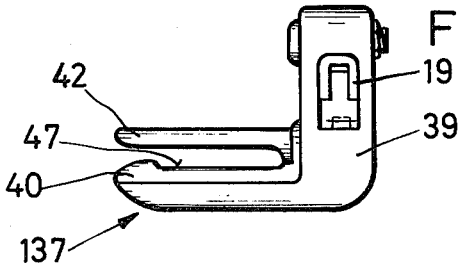
FIG. 6 is a sectional view of a roving holder modified with respect to FIG. 4.

The holder 137 illustrated in FIG. 6 exhibits a lower degree of roving clamping force because a slot 47 is formed in the surface of the table 40 opposite to the pivot rod 42. Thus, when the pivot rod 42 is rotated to hold the roving a small gap, defined by the slot 47, exists between the outer jacket of the rod 42 and the table 40. Thus, the fiber tuft can be held securely, but fibers floating in the roving holder 137 at the time of the blockage can be pulled along, due to the fact that they are less firmly held by the arbor than those that have already entered into the subsequent clamping point (i.e. belts 9, 10). The remaining share of floating fibers in the fiber tuft formed is reduced accordingly.

Figure 7:
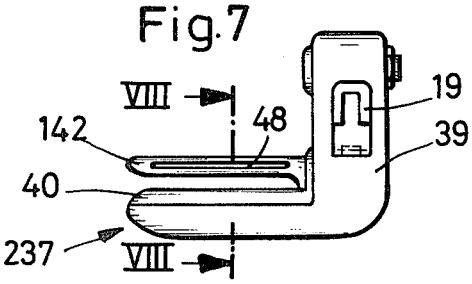
FIG. 7 is a front view of another form of a roving holder.
Figure 8:
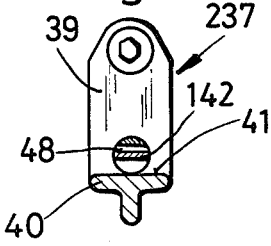
FIG. 8 is a side view taken along line VIII—VIII of FIG. 7.

The same applies to the roving holder 237 illustrated in FIGS. 7 and 8 which like the table 40, illustrated in the FIG. 1 is provided with a flat level surface 41. The pivot rod 142 which is formed preferably of a plastic material, is provided with a transverse slot 48, as a result of which its jacket becomes elastic. Thus, a roving located between the pivot rod 142 and the table 40 is not held ridigly, but elastically in the holding position making it therefore possible for still floating fibers to be drawn off from the detained roving.

Such an elastically resilient holding of the roving results also if the entire arbor is designed as an elastic part.

The blocking device 12 and the roving holder 37 described can be attached without any difficulties and in a simple manner to already operating machines. Since the bearing rail 19 combines the mechanism controlling the blocking member 13 and also couples it with the holder 37, one structural or sub-assembly group is formed. The assembly can, as may be seen in particular from FIG. 2, easily mountable on the machine by respective placing of the carrying member 20 on the support rod 1 and by appropriate placement of the holder 37 on the bearing rail 19. Further, it may be easily arranged with the support and load carrying arm equipped with twin upper rolls both on its one and/or on its other side, whereby the same blocking shell 13 can be used because the latter is provided at both axial ends with coupling joints 15. In one case one, and in the other case the other coupling joint 15 is connected with the coupling projection 17 of the slide 18. The exposure of the table 40 and of the pivot rods 42, 142 on each side has the advantage that the lateral aperture of the holder created as a result of the above insertion of the roving into the holder can be made in a simple manner. The holder can also be pushed in a simple manner over the roving. Of course, the holder can also be used in conjunction with any other form of blocking device than that illustrated, for instance with a blocking device, in which instead of a blocking shell seated on the lower roll, a wedge-shaped blocking member is pushed or tilted between the entry rolls.

In the embodiment shown in FIGS. 9 to 13, a support 2 is also fastened to the support rod 1 mounted on the machine, in which the support and load carrying arm 4 shown in its operating position is held pivotable about the bearing 3. Upper rolls 5', 6', 7', respectively, are arranged on the support and load carrying arm 4 in opposition to the driven lower rolls 5, 6, 7. The lower belt 9, and the upper belt 10, which run over the lower roll 6 and upper roll 6', respectively, are similarly provided with a cage, not shown.

The components of the device for blocking and holding the roving are arranged on a bearing rail 119, which, in variance to the example pursuant to the FIGS. 1 to 8, is arranged to be pivotable in the carrying member, denoted generally by the numeral 120, which is mounted on the support rod 1.

The bearing rail 119 is attached (see FIG. 10) with its end section adjacent the support rod 1, to the lower part 50 of a housing generally denoted by the numeral 51, the hood-like cover 52 of which lies over the electromagnet 125 fastened to the lower part. The anchor 128 engages with its bolt 129 in a notch of the slide 118 guided in the bearing rail 119.

A coupling plate 53 is fixed to engage depressions in the lower part 50 and in the lid 52 by means of form locking projections 54 and 55. The coupling plate 53 and the lower part 50 are fastened by means of a nut 56 on an offset section 57 of a bearing bolt 58 which passes through a spring housing 59 attached to the support rod 1. The bearing bolt 58 is capable of pivoting in a housing 59 which is mounted, as can be seen from FIG. 9, on the support rod 1 by means of a strap 60 and a fastening bolt 61. A torsion spring 62, bracing with one end **62*a* against an edge of the spring housing 59 and bearing with its other end 62*b* on a curved bracket 63 integral with the coupling plate 53 and which projects into the spring housing 59. The torsion spring 62 biases the coupling plate 53, with the housing 51 and the bearing rail 119 mounted in it, counterclockwise (as seen in the Fig.) about the bearing bolt 58. This swivel movement is limited by a stop at a point, at which the bearing rail and the components of the device for blocking and holding the roving assigned to it have reached their operating position, in which they are then held by the torsion spring 62 parallel to the roving 11**.

The stop could, e.g. be determined by an end edge of the slot-like breakthrough in the spring housing 59, through which the bracket 63 projects. This requires, however, that the spring housing must be fastened in a correspondingly precise rotational position on the support rod 1. The adjustments required for the determination of the operating position are made easier, however, if, as shown in FIG. 9, the stop is formed by a positive machine stop surface and by an adjustable countersurface arranged on the bearing rail 119.

The positive machine stop surface used is the surface of the bridge 8 facing the bearing rail 119, and the countersurface is the collar 64 of an adjusting screw 65 abutting on the bridge 8 under the force of the torsion spring 62. The adjusting screw 65 is seated in a holder 66 which can be adjusted lengthwise along the bearing rail 119. The adjusting screw 65 is held, for example, in a nut 67 which is firmly implanted into the holder 66. The screw can be arrested in a fixed position by tightening a lock nut 68 against the end of the holder 66. The holder 66 is preferably plastic and by tightening the lock nut 68, a dynamic force is created which also secures the holder 66 on the bearing rail 119, in a fixed selected position. When the adjusting screw 65, as illustrated, is furthermore provided with a freely extending pin 69 projecting beyond the countersurface 64 into engagement with a bore formed in the bridge 8, the result is that in addition to the height adjustment of the bearing rail 119 with respect to the plane of the roving through the rollers, there is also attained a lateral fixation of the rail. Because the rail is secured by the extending pin 69 at a great distance from the fastening point of the bearing rail 119, i.e., the shaft 58, a much more stable mounting of the bearing rail 119 on the machine is assured. The adjusting screw 65 may, as illustrated, be arranged on a lateral outer side of the bearing rail 119 in the holder 66. It also can be arranged, however, in such a way that it penetrates through the bearing rail, in which case the bearing rail would have to be provided with a longitudinal recess determining the adjusting range of the holder.

Swivelling the bearing rail 119 manually about the shaft 58 against the force of the torsion spring 62 allows the rail to be moved from the vicinity of the lower rolls 5, 6, and 7 so that cleaning, maintenance, or changeover work may be expediently carried out. In order to be able to fix the bearing rail 119 in a simple manner in an upper or nonoperating position against the force of the torsion spring 62, a catch device acting on the bracket 63 is provided in the spring housing 59.

For this purpose, a notch 70 is fitted into the outer surface of the bracket 63, and a cam 71 is adapted to ride on the outer surface of the bracket. The cam 71 is mounted on a pair of opposed pins 72, which project laterally into longitudinal slots in the walls of the spring housing 59. The two pins 72 can be the free ends of a single stud inserted through the cam 71. Extending from the top surface of the cam 71 is a shaft 73 which protrudes from a hole in the top wall of the housing 59. A coil spring 74 is placed over the shaft 73 and braces itself on the one hand against the top wall of the spring housing 59 and on the other hand against the stop cam 71 to bias the cam 71, in the illustrated position against the pins 72 in such a way that the cam is normally maintained in fixed separation from the curved bracket 63 by the distance of the slot through which the bracket 63 extends and does not influence the action of the torsion spring on the bearing rail 119. The cam 71 comes into contact with the bracket 63 only during the tilting upwards of the rail 119 into its nonoperating position so that the cam 71 is pushed back into its guide 72*a* against the force of the spring 74 until it finally engages the notch 70. The then attained nonoperating position of the bearing rail 119 is denoted by the dash-dot line 75 drawn in FIG. 9.

This tilting of the bearing rail 119 is, should the case arise, only possible if the support and load carrying arm 4 with the upper rolls held by it has been itself previously tilted into its nonoperating position. This position identified in FIG. 9 by the dash-dot line 179 is also detemined by a catch coupling. It would also be necessary in this case to swivel at first the bearing rail and thereafter the support arm back into the operating position. If this sequence of the activation were disregarded, structural components on the bearing rail and support arm could contact each other and damage could be caused in the attempt to forcably move the components past each other. In order to safely avoid such damage, lobes or the like are arranged sticking out from the sides of the support arm to overlap the rails and prevent them from being tilted upward as long as the support arm remains in its operating position.

Since as a rule both the support arms and also the bearing rails associated with them on both sides must be swiveled for cleaning, maintenance, or changover jobs into the nonoperating position and thereafter be swiveled back again into the operating position, a device, coupling these parts with respect to their swivel movements is provided for the simplification of the maniupulations required for this purpose. It consists, as shown especially in FIG. 13 of a two armed coupling yoke 76 which is placed on the support and load carrying arm 4 and integrally connected as shown, by a bolt with the arm 4. Coupling claws 79 open along their lower edge are situated at the ends of each arm 78, and have hooks formed on their free end which are pressable over the bearing rails 119, surrounding the rail with some clearance. After overcoming the play of the bearing rails 119 inside of the coupling claws 79, the bearing rails are taken along during the swinging movements of the support and load carrying arm 4. The play existing in the tilting direction and also laterally to the latter is provided for the purpose of preventing operating forces from the support arm 4 and the coupling bracket 76 to exert their influence on the operating position of the bearing rails 119, and to permit displacements of the bearing rails 119 occurring within the coupling bracket 76 during the swiveling action, because the coupling bracket 76 moves about the bearing 3 of the support arm 4 which is located at a distance from the swivel bearing 58 of the bearing rail 119. A possible fastening site of the only partially shown coupling bracket 76 on the support and load carrying arm 4 is illustrated in FIG. 9

As in the earlier embodiment the body 39 of the roving holder 37 is fastened by means of a clamping screw 38 on the bearing rail 119 within the area of the forefield, i.e., between roller pairs 5 and 6 of the draw frame in a lengthwise adjustable manner. On the side of the holder body 39, projecting freely and extending beneath the roving 11, projects a table 40. Above the table 40 extends a pivot rod 42, pivoting in the body 39 and also freely projecting from the latter. The pivot rod 42 is flattened on one side, and between this flattened surface 43 and the table 40 exists the slot 44, within which the roving 11 can freely move. The pivot rod 42 engages a rack 146 on the upper edge of the slide 118 guided in the bearing rail 119 by means of a gear 45 attached to it. During the movement actuating the roving blocking device 112, the pivot 42 is rotated in such a manner that the fiber tuft of the roving created in the forefield during blockage is detained between the table 40 and the unflattened outer surface of the pivot rod 42.

Furthermore, the blocking device generally denoted by the numeral 112 is designed as a one-piece component carrying out all blocking functions, and is arranged on the bearing rail 119.

Figure 11:
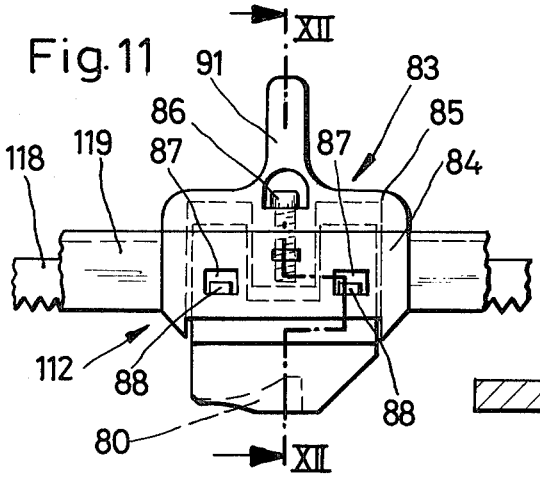
FIG. 11 is a lateral view of the blocking member illustrated of FIG. 9.
Figure 12:
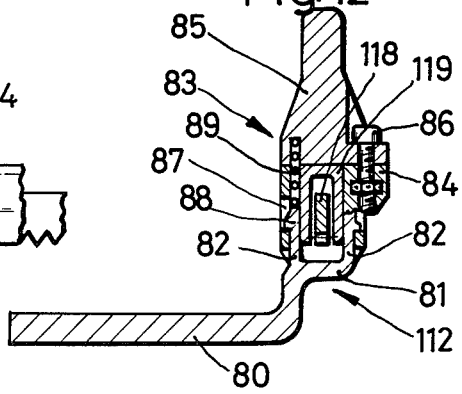
FIG. 12 is a sectional view of the blocking member taken along line XII—XII of FIG. 11.
Figure 13:
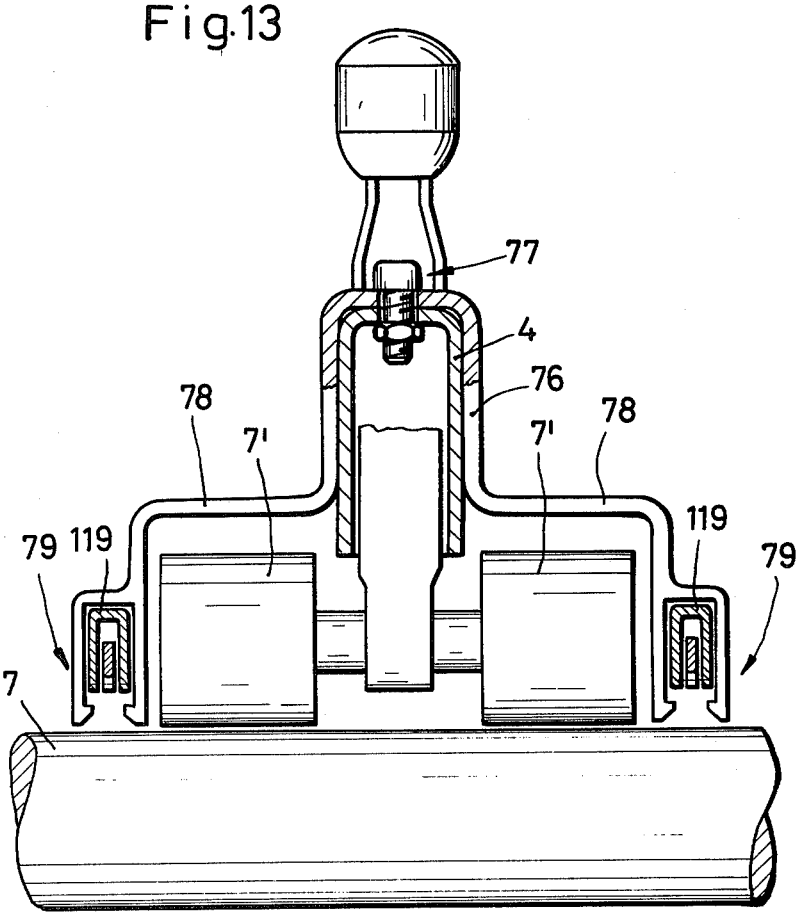
FIG. 13 is a front view of the support arm with a dome shaped lifting bracket placed on top of the latter.

It can be seen from FIGS. 9, 11 and 12 that the blocking device comprises a wedge 80 which enters the clamping point formed by the entry roll pair 5, 5' lifting the upper roll 5' from the lower roll 5 and holding the roving 11 between itself and the upper roll 5'. The wedge 80 is attached to the bearing rail 119 and movable lengthwise in a guide comprising a fork-shaped guide member 81 which is formed at one end of the otherwise freely projecting blocking wedge 80. The guide member 81 grips the bearing rail 119 which has the same inverted U-shaped profile from its open bottom edge and laterally facing with the inner surfaces of its two legs 82 the lateral outer surfaces of the bearing rail 119. The two legs 82 of the guide member 81 engages a blocking wedge housing 83 fastened on the bearing rail 119 and is guided in it in a movable manner. The blocking wedge housing 83 is composed of a lower housing part 84 embracing the bearing rail 119 at its open U-shaped side and the two U-shaped sides of the leg, and a lid 85 overlying the bearing rail 119 on its then still free surface. The two parts 84 and 85 are rigidly connected with each other by a screw 86. To limit the movement of the guide member 81 in the housing 83, slots 87 are made in the side of its lower part 84 which are engaged by projections 88 formed on the outer surfaces of the legs 82 of the guide member. The inside shape of the slots 87 in relation to the size and shape of the projections 88 determines the movement potential of the guide member 81 within its mounting in the lower part 84. The saw tooth-like design of the projections 88 shown in FIG. 12 makes it possible to insert the guide member 81 simply from below into the lower part 84 by utilizing the inherent spring action of the legs 82, prior to placing the parts on the bearing rail 119. The pressure spring 89 is inserted in the housing 83, bracing against the lid 85, and acting on the leg 82 of the guide member 81, to hold the latter in the limit position determined by the placement of the projections 88 on one of the edges of the perforations 87. In the operation position (FIG. 9) of the parts, the described limited movement of the guide member 81 and of the blocking wedge 80 relative to the blocking wedge housing 83 occurs in a direction running at a right angle to the plane of the stretching or drawing field plane.

Teeth 90 are formed in the lower part 84 of the housing 83 and engage a rack 146 formed on the lower edge of the slide 118 when the housing 83 is fastened on the bearing rail 119. The housing 83, which is movable lengthwise in its fastened position together with the guide member 81 and the blocking wedge 80 on the bearing rail 119, is thus connected with the slide 118 and participates in its movements. When the screw 86 loosened, it is possible to establish the positive locking engagement of the parts 90 and 146 at any desired point of the slide 118, and therefore to adapt the position of the roving blocking device 112 to the draw frame.

As is evident from FIG. 9, the interlocking connection of the parts 90 and 146 is carried out in such a way that the wedge 80 is located in the operating and readiness position outside of the range of movement of the roving 11. The wedge faces the pair of entry rolls 5, 5′ at a distance from these rolls, and is located below the plane of the stretching or drawing field. The last mentioned position results by proper adjustment of the adjusting screw 65. When a yarn breakage signal is transmitted by the thread sensor to the electromagnet 126, the latter releases the slide 118 for its forward movement under the force of the pressure spring associated with it. The blocking wedge housing 83 with the wedge 80 are moved along with the slide 118 and are thereby displaced in the direction of the pair of entry rolls 5, 5′. The wedge 80 comes at first in contact with its edge facing and engaging the lower roll 5, and slides on top of the latter. The guide member 81 is thereby displaced upwardly against the pressure spring 89 within its limitation in the blocking wedge housing 83. The blocking wedge 80 and its guide member 81 can thereby also execute a tilting movement facilitating the sliding-on motion, if, as illustrated, the projections 88 have a slight lateral play within the perforations 87.

During its slide-on movement, the wedge 80 comes into contact with the roving 11, and thereafter in continuing its movement it lifts, bracing itself against the lower roll 5, the upper roll 5′ from the latter. After the then terminated movement of the blocking wedge, the roving 11 is jammed between the blocking wedge 80 and the non-stationary upper roll 5′, and is blocked from continued movement. Simultaneously with this blockage, the slide 118 also moves the holder 37 into a position holding the fiber tuft just formed.

It is shown by the formation and arrangement of the part described that the force required for lifting the upper entry roll 5′ cannot act with the same certainty as a bending force acting on the bearing rail 119, but is applied by bracing of the blocking wedge 80, to the lower entry roll 5. The resting of the blocking wedge 80 on the rotating lower roll 5 supports the movement of the blocking wedge. In the blocking position the blocking wedge 80 is finally pulled by the lower roll because it is pressed on the latter by the upper roll. During this drawing in movement of the blocking wedge 80 the upper roll is lifted off.

We claim:

1. A draw frame for a spinning machine converting a roving into a thread having upper and lower paired inlet and outlet rollers and an upper and lower paired drafting rollers therebetween, means for sensing a break in said thread, a blocking device for arresting the motion of said roving, and a holding device for securing the forward end of said roving in alignment with said drafting rollers, switch means operable in response to said sensing means for operating said blocking and holding devices, said holding device being adjustably mounted between said paired inlet rollers and said drafting rollers along the path of movement of said roving.

2. The draw frame according to claim 1 including a supporting rail mounted to extend parallel to the direction of said roving movement, said holding device being mounted on said supporting rail, said supporting rail including a slide member, a spring biasing said slide member toward said drafting rollers, said switch means being mounted on said supporting rail and adapted to releasably engage said slide when said slide is moved against the bias of said spring means, said slide being operable on release of said switch means to operate both said blocking device and holding device.

3. The draw frame according to claim 2 wherein said holder comprises a fixed member and a movable member, one extending below said roving the other above said roving.

4. The draw frame according to claim 3 wherein fixed and movable members extend parallel to the axes of said rollers.

5. The draw frame according to claim 2 wherein said roving holder comprises a table mounted cantilevered below said roving and a shaped arm is mounted above said roving, said arm being rotatable synchronously with said blocking mechanism into a first position to hold the end of said roving to said table, and into a second position to permit said roving to pass freely therebetween, said shaped arm having a pinion, and said slide having a rack engaging therewith to pivot said arm.

6. The draw frame according to claim 5 wherein said arm is flexible.

7. The draw frame according to claim 6 wherein said arm is provided with an elongated slot to render said arm flexible.

8. The draw frame according to claim 5 wherein said table is provided with a slot to accommodate said roving.

9. The draw frame according to claim 2 wherein said blocking device comprises a shell surrounding the lower one of the paired inlet rollers, said shell having a coupling extending at at least one of its ends to engage with the slide.

10. The draw frame according to claim 2, wherein said blocking member comprises a wedge secured to said slide for conjoint movement and movable parallel to the direction of said roving into and out of engagement between said paired inlet rollers.

11. The draw frame according to claim 10 wherein said blocking member is slidable and is provided with a tooth adapted to engage the rack of said slide.

12. The draw frame according to claim 17 wherein said wedge is movable with respect to said supporting rail at right angles to plane of said roving and is biased by a spring to lie below the side of said roving pointing to the lower roll.

13. The draw frame according to claim 2 wherein said supporting rail is pivotally mounted at its rear end on a bearing secured to the framework of said draw frame, to be movable between an operative position parallel to the direction of roving movement and a non-operative position at an angle to said roving movement, said supporting rail being positioned by a spring, and being provided with stop means limiting the movement of said rail in both positions, said stop means comprising a catch and nose engageable to hold said rail in the non-operative position.

14. The draw frame according to claim 13 wherein the stop in the operative position comprises a bar attached to the bottom bridge between the forward rollers and an adjustable countersurface mounted on the support rail.

15. The draw frame according to claim 14 wherein said adjustable countersurface comprises an end of a screw extending perpendicular to the axis of said support rail, and extending through a boss formed with said rail.

16. The draw frame according to claim 13, wherein the support rail is coupled to the support arm.

17. The draw frame according to claim 16 wherein said coupling comprises a bracket seated on said support arm, and releasably engaging said supporting rails.

18. The draw frame according to claim 13 wherein a housing is mounted on the bar of the framework, said housing having catch, a spring, located therein in said supporting rail having mounted thereon a nose adapted to engage said catch.

* * * * *